US008651647B2

(12) United States Patent
Aruga et al.

(10) Patent No.: US 8,651,647 B2
(45) Date of Patent: Feb. 18, 2014

(54) LIQUID EJECTING APPARATUS, AND NOZZLE RECOVERY METHOD USED IN LIQUID EJECTING APPARATUS

(75) Inventors: Tomohiro Aruga, Matsumoto (JP); Masaru Kobashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 211 days.

(21) Appl. No.: 13/022,598

(22) Filed: Feb. 7, 2011

(65) Prior Publication Data

US 2011/0193920 A1 Aug. 11, 2011

(30) Foreign Application Priority Data

Feb. 8, 2010 (JP) ..... 2010-025279

(51) Int. Cl.
*B41J 2/18* (2006.01)
*B41J 2/175* (2006.01)

(52) U.S. Cl.
USPC ..... 347/93; 347/89

(58) Field of Classification Search
USPC ..... 347/93, 89
See application file for complete search history.

(56) References Cited

U.S. PATENT DOCUMENTS

| | | | | |
|---|---|---|---|---|
| 7,172,271 | B2 * | 2/2007 | Tominaga et al. | 347/68 |
| 7,661,798 | B2 * | 2/2010 | Mukai et al. | 347/56 |
| 2006/0066698 | A1 * | 3/2006 | Takatsuka | 347/93 |
| 2007/0126816 | A1 | 6/2007 | Nishida | |

FOREIGN PATENT DOCUMENTS

JP 2007-152725 A 6/2007

* cited by examiner

*Primary Examiner* — Matthew Luu
*Assistant Examiner* — Renee I Wilson
(74) *Attorney, Agent, or Firm* — Kilpatrick Townsend & Stockton LLP

(57) ABSTRACT

A liquid ejecting apparatus includes a recording head that ejects an ink from a plurality of nozzles, a liquid supply passage and a reservoir that supply the ink from an upstream side toward a downstream side, a maintenance pump that is able to suck and discharge the ink from and to the liquid supply passage, a filter that clarify the ink in the reservoir, and a control unit that performs a recovery process of the nozzles by controlling an operation of the pump, wherein the control unit causes the maintenance pump to perform a sucking operation to suck the ink, and then causes the pump to perform a discharging operation to discharge the ink, thereby supplying the ink clarified by the filter to the nozzle side.

6 Claims, 5 Drawing Sheets

LIQUID EJECTING APPARATUS, AND NOZZLE RECOVERY METHOD USED IN LIQUID EJECTING APPARATUS

BACKGROUND

1. Technical Field

The present invention relates to a liquid ejecting apparatus such as an ink jet printer and a nozzle recovery method used in a liquid ejecting apparatus.

2. Related Art

Ink jet printers have been widely known as liquid ejecting apparatuses for ejecting liquid to a target. These printers perform printing (image formation) on the target by ejecting ink (liquid) supplied to a recording head (liquid ejecting head) from nozzles provided in the recording head.

In one of these printers, when bubbles are incorporated into the ink in the recording head, the ink cannot be properly ejected from the nozzles, resulting in degradation in printing quality. Accordingly, in such a printer, for example, as disclosed in JP-A-2007-152725, a nozzle recovery process is performed by pressurizing the ink, which is supplied from an ink cartridge to the recording head, and thereby pushing the ink containing the bubbles out of the recording head through nozzle openings.

Ink ejection failure caused by the incorporation of bubbles may not occur in all nozzles. Accordingly, as disclosed in JP-A-2007-152725, when the nozzle recovery process is performed by pressurizing the ink supplied from the ink cartridge to the recording head, the ink is pressurized to be supplied to even nozzles that properly eject ink. As a result, the ink is wastefully discharged from the nozzles in normal condition, and a large amount of ink is wasted due to the nozzle recovery process.

SUMMARY

An advantage of some aspects of the invention is to provide a liquid ejecting apparatus capable of performing a nozzle recovery process while suppressing liquid consumption, and a nozzle recovery method used in a liquid ejecting apparatus.

According to an aspect of the invention, there is provided a liquid ejecting apparatus including: a liquid ejecting head that ejects a liquid from a plurality of nozzles; a liquid supply passage that supplies the liquid from an upstream side which is a liquid supply source side toward a downstream side which is the nozzle side; a pump that is able to suck the liquid in the liquid supply passage and discharge the liquid to the liquid supply passage; a liquid filtration unit that clarifies the liquid in the liquid supply passage; and a control unit that performs a recovery process of the nozzles by controlling an operation of the pump, wherein the control unit drives the pump to perform a sucking operation to suck the liquid in the liquid supply passage to the pump, and drives the pump to perform a discharging operation to discharge the liquid sucked to the pump by the sucking operation of the pump to the liquid supply passage, thereby supplying the liquid clarified by the liquid filtration unit to the nozzle side.

In this configuration, when the pump is driven to perform the sucking operation, the liquid in the liquid supply passage is sucked. Then, the bubbles incorporated into the liquid in the liquid ejecting head are moved into the liquid supply passage along with the liquid and thus the liquid is clarified by the liquid filtration unit. Accordingly, thereafter, when the liquid is discharged to the liquid supply passage as the pump is driven to perform the discharging operation, the clarified liquid is moved to the nozzle side as a result of receiving the discharge pressure. Moreover, as the capillary force of the nozzles is exerted, the nozzles are filled with the clarified liquid, thereby completing the recovery process of the nozzles. As such, during the recovery process of the nozzles, the bubbles incorporated into the liquid can be removed without discharging the liquid out of the nozzle opening. Therefore, the recovery process of the nozzles can be performed while suppressing liquid consumption.

The liquid ejecting apparatus may further include: a circulation passage of which ends are communicated with the liquid supply passage; and a circulation unit that flows the liquid in the liquid supply passage from an end of the circulation passage into the circulation passage and flows the liquid out of another end of the circulation passage to the liquid supply passage.

In this configuration, the liquid in the liquid supply passage can be caused to flow by the circulation passage and the circulation unit. Accordingly, for example, even in the case where the liquid evaporates and the viscosity of the liquid increases, the sucked liquid and liquid which is supplied from the upstream side and has low viscosity are mixed with each other, thereby reducing the viscosity of the ink. Therefore, the viscosity of the thickened liquid can be reduced and the liquid can be re-filled in the nozzles, thereby performing the recovery process of the nozzles while suppressing liquid consumption.

In the liquid ejecting apparatus, the liquid filtration unit may be a filter provided in the circulation passage.

In this configuration, as the filter is provided in the circulation passage, the liquid which is acquired from the liquid supply passage and caused to flow through the circulation passage passes through the filter and is caused to flow out to the liquid supply passage. Therefore, bubbles in the liquid or foreign matter incorporated into the liquid can be easily removed.

According to another aspect of the invention, there is provided a nozzle recovery method used in a liquid ejecting apparatus which includes a plurality of nozzles that eject a liquid, and a liquid supply passage that supplies the liquid from an upstream side which is a liquid supply source side to a downstream side which is the nozzle side, the nozzle recovery method including: sucking the liquid in the liquid supply passage by causing a pump, which is able to suck the liquid in the liquid supply passage and discharge the liquid in the liquid supply passage, to perform a sucking operation; clarifying the liquid sucked in the sucking; and discharging the clarified liquid toward the nozzle side by causing the pump to perform a discharging operation.

In this configuration, the same operations and effects as those of the liquid ejecting apparatus according to the aspects described above can be exhibited.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a fluid ejecting apparatus embodied as an ink jet printer according to exemplary embodiments of the invention will be described with reference to the accompanying drawings. Moreover, in the following description, a "left and right direction" and an "up and down direction" respectively represent a left and right direction and an up and down direction indicated by arrows in FIG. 1. In addition, a "front and rear" direction represents a direction perpendicular to the paper plane of FIG. 1.

Figure 1:
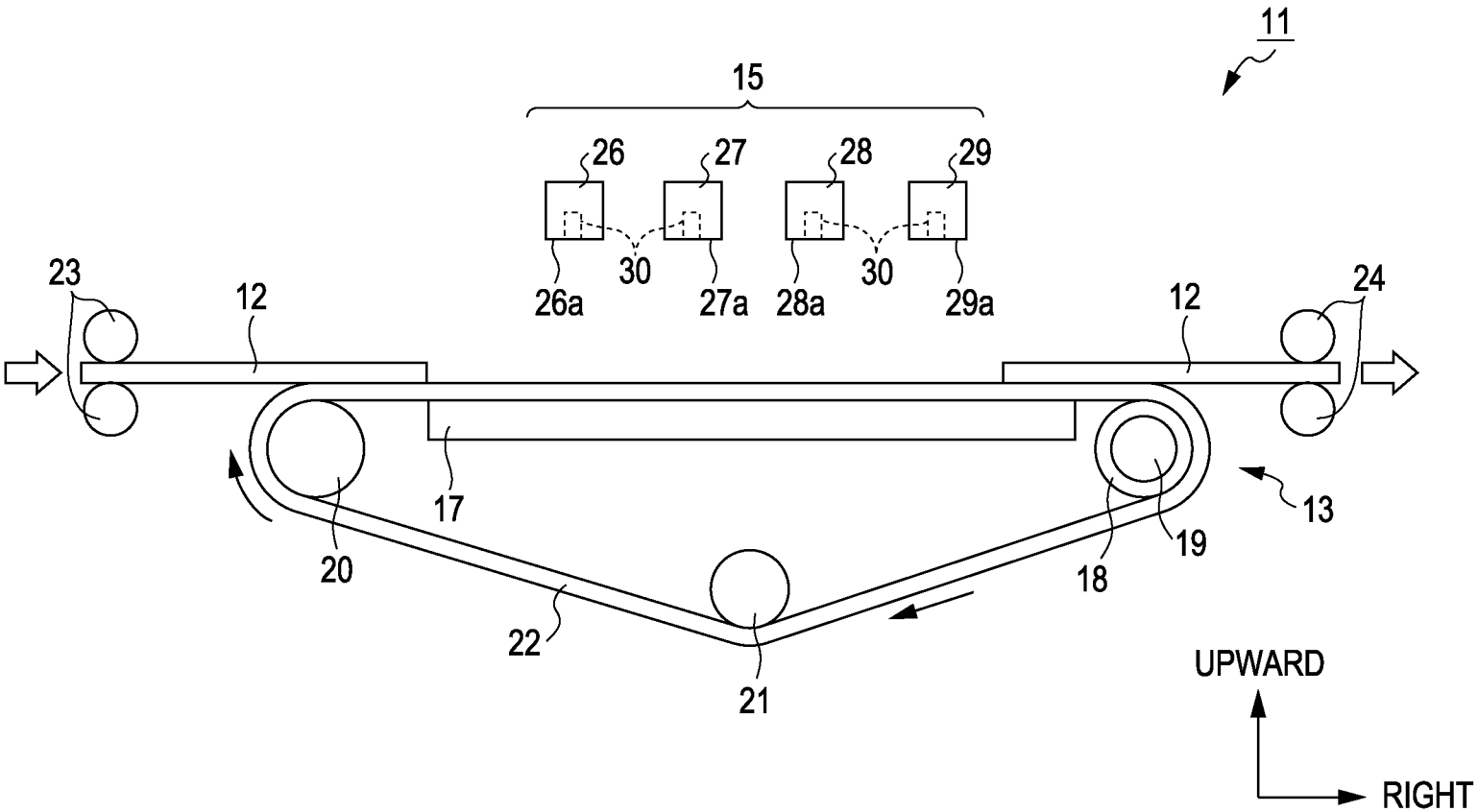
FIG. 1 is a schematic diagram of a printer according to an embodiment.

As illustrated in FIG. 1, an ink jet printer (hereinafter, also called a "printer") 11 as a liquid ejecting apparatus includes a transportation unit 13 for transporting a sheet 12 as a target, and a recording head unit 15 for performing printing on the sheet 12.

The transportation unit 13 includes a platen 17 which has a long rectangular plate shape in the left and right direction. A driving roller 18 extending in the front and rear direction is disposed on the right of the platen 17 so as to be rotated by a driving motor 19, and a driven roller 20 extending in the front and rear direction is disposed on the left of the platen 17 to be rotatable. Moreover, a tension roller 21 extending in the front and rear direction is disposed below the platen 17 to be rotatable.

A transportation belt 22 with no ends which has a number of through-holes is wound on the driving roller 18, the driven roller 20, and the tension roller 21 to surround the platen 17. In this case, the tension roller 21 is biased toward the lower side by a spring member (not shown) to exert tension on the transportation belt 22, thereby suppressing looseness of the transportation belt 22.

In addition, as the driving roller 18 is rotated clockwise when viewed from the front, the transportation belt 22 is revolved clockwise over the outer sides of the driving roller 18, the tension roller 21, and the driven roller 20 when viewed from the front. In addition, in a case where the sheet 12 is at a position opposed to an upper surface of the platen 17, the sheet 12 is sucked by a sucking unit (not shown) toward the platen 17 over the transportation belt 22 so as to be transported from the left which is an upstream side to the right which is a downstream side.

In addition, obliquely upward on the left of the driven roller 20, a pair of upper and lower feeding rollers 23 is provided for sequentially feeding a plurality of sheets 12 on which printing is not performed to the transportation belt 22 sheet by sheet. On the other hand, obliquely upward on the right of the driving roller 18, a pair of upper and lower discharging rollers 24 is provided for discharging the sheets 12 which have been subjected to printing from the transportation belt 22 sheet by sheet.

Figure 2:
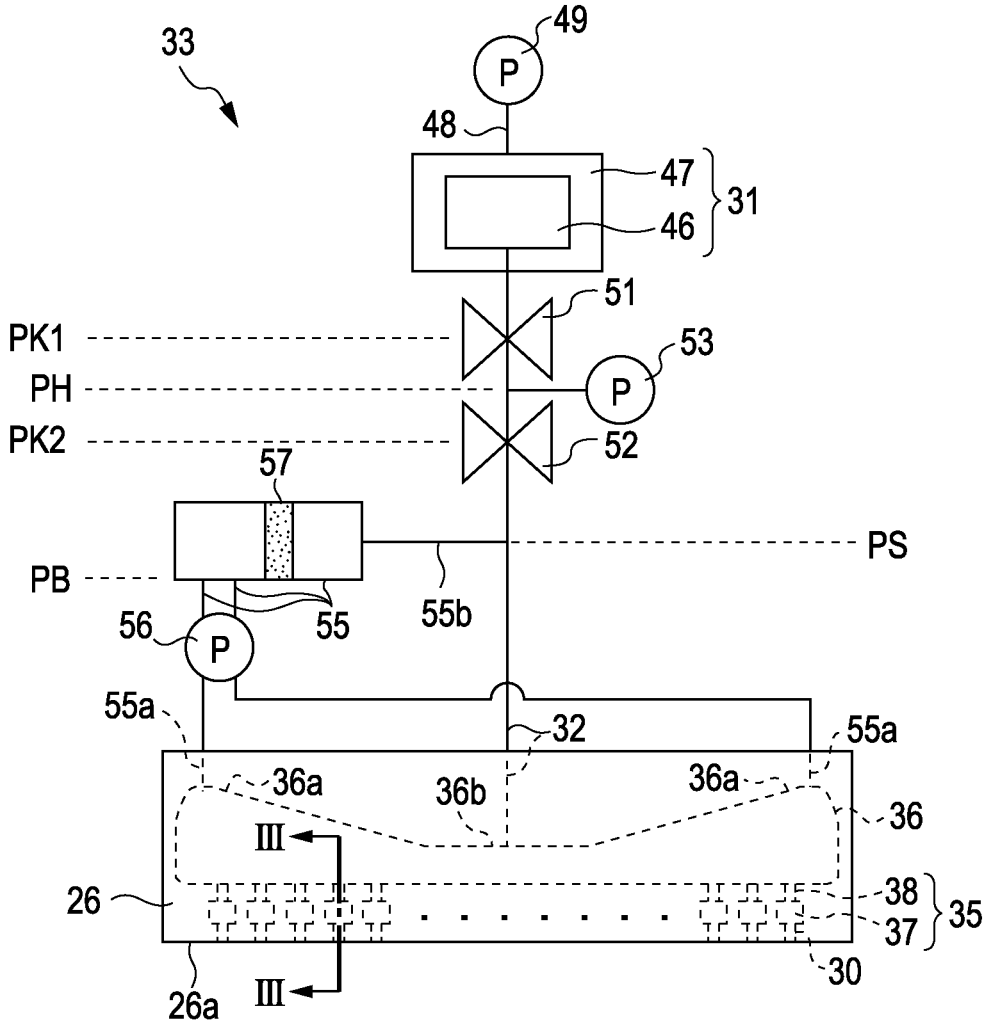
FIG. 2 is a schematic diagram of an ink supply system.

As illustrated in FIGS. 1 and 2, in the recording head unit 15, recording heads 26 to 29 as a plurality of (in this embodiment, 4) liquid ejecting heads extending in the front and rear direction are provided at intervals in the left and right direction. Moreover, on nozzle formation surfaces 26*a* to 29*a* which are lower surfaces of the respective recording heads 26 to 29, a number of nozzles 30 are regularly open at predetermined intervals in the front and rear direction to form nozzle rows along the front and rear direction. In addition, inks (liquids) corresponding to the recording heads 26 to 29 are supplied to the nozzles 30 configured as described above so as to be ejected from the nozzles 30.

Specifically, as illustrated in FIG. 2, an ink supply apparatus 33 for supplying black ink via an ink passage 32 as a liquid supply passage from the ink cartridge 31 as a liquid supply source which contains the black ink is connected to the first recording head 26. In addition, similarly, the ink supply apparatuses 33 for supplying inks from the ink cartridges 31 which respectively contain inks of cyan, magenta, and yellow colors are respectively connected to the second to fourth recording heads 27 to 29.

Here, since the configurations of the ink supply apparatuses 33 for supplying the inks to the respective recording heads 26 to 29 from the ink cartridges 31 are the same, in FIG. 2, only the single ink supply apparatus 33 for supplying the ink to the first recording head 26 is illustrated together with the first recording head 26 and the ink cartridge 31. In addition, hereinafter, the first recording head 26 and the ink supply apparatus 33 for supplying ink to the first recording head 26 illustrated in FIG. 2 are exemplified for the description.

As illustrated in FIG. 2, a reservoir 36 which communicates with a downstream side of the ink passage 32 is provided in the first recording head 26 to extend in the front and rear direction along the nozzle row. Moreover, an inner surface of an upper wall of the reservoir 36 is obliquely formed. That is, both end portions 36*a* of the reservoir 36 in the front and rear direction are higher than a center portion 36*b* thereof in the up and down direction. In addition, a plurality of branched passages 35 individually corresponding to the nozzles 30 branch off at a plurality of positions in the extension direction (front and rear direction) of the reservoir 36.

Figure 3:
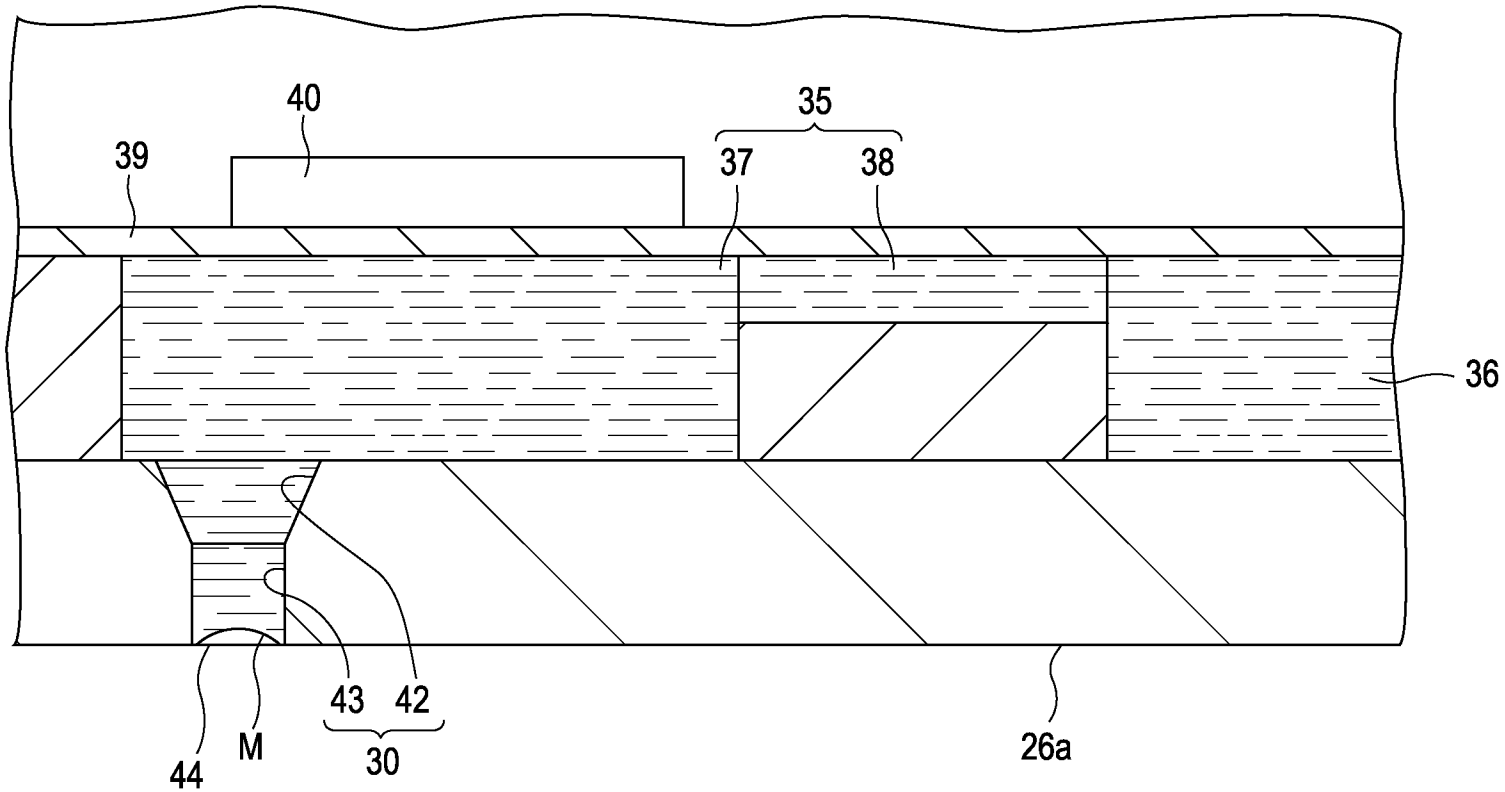
FIG. 3 is a schematic cross-sectional view taken along the arrow III-III of FIG. 2.

As illustrated in FIGS. 2 and 3, the branched passage 35 includes a cavity 37 which communicates with the nozzle 30 and a communication passage 38 for communicating the cavity 37 and the reservoir 36 with each other. Moreover, in a direction perpendicular to the ink flow direction (a direction perpendicular to the paper plane of FIG. 3), a cross-sectional area of the communication passage 38 is smaller than that of a passage cross-sectional area of the cavity 37.

Moreover, as illustrated in FIG. 3, a piezoelectric element 40 is disposed at a position adjacent to the cavity 37 with a vibration plate 39 interposed therebetween which forms a wall surface of the cavity 37. That is, as the piezoelectric element 40 retracts and extends and thus vibrates the vibration plate 39, a volume of the cavity 37 is changed and ink is ejected from the nozzle 30. In addition, when an amount of the ink in the cavity 37 is reduced due to the ejection, ink is supplied from the ink cartridge 31 via the communication passage 38, the reservoir 36, and the ink passage 32. Therefore, the branched passages 35, the reservoir 36, and the ink passage 32 function as a liquid supply passage for supplying ink from the upstream side which is the ink cartridge 31 side to the downstream side which is the nozzle 30 side.

In addition, the nozzle 30 includes a tapered portion 42 with a gradually reduced cross-sectional area from the upstream side communicated with the cavity 37 toward the downstream side, and an opening portion 43 which communicates with the tapered portion 42 and is open to the nozzle formation surface 26*a*. In addition, when the ink is filled in the nozzle 30 from the upstream side, a meniscus M is formed in the vicinity of a nozzle opening 44 which is provided in the nozzle 30 and open to the nozzle formation surface 26*a*. Here, the meniscus M is a curved surface which is swollen by a capillary action to cause a center portion of the ink to form a concave shape as viewed from the nozzle opening 44.

In addition, as illustrated in FIG. 2, in the ink cartridge 31, an ink pack 46 which contains ink and has flexibility is accommodated in a case 47. In addition, a pressurizing pump 49 is connected to the case 47 via an air passage 48, and an upstream end of the ink passage 32 is communicated with the ink pack 46. Accordingly, when the pressurizing pump 49 supplies air to the case 47 via the air passage 48, the ink pack 46 is squeezed such that the ink in the ink pack 46 is supplied to the ink passage 32.

In addition, in the ink passage 32, at an upstream side opening and closing position PK1 as a second position, a first passage valve 51 as an upstream side passage valve which is able to open and close the ink passage 32 is provided. In addition, at a downstream side opening and closing position PK2 as a third position which is on the downstream side in relation to the upstream side opening and closing position PK1, a second passage valve 52 as a downstream side passage valve which is able to open and close the ink passage 32 is provided.

In addition, to a pressure-changing position PH as a first position which is between the upstream and downstream side opening and closing positions PK1 and PK2, a maintenance pump 53 is connected as a pump which is able to change pressure in the ink passage 32 to suck and discharge the ink. In addition, on the upstream side in relation to the upstream side opening and closing position PK1 in the ink passage 32, a one-way valve (not shown) which allows a flow of ink from the upstream side to the downstream side in response to a pressure reduction of the downstream side is provided.

In addition, at a communicating position PS which is on the downstream side in relation to the downstream side opening and closing position PK2 in the ink passage 32, a circulation passage 55 is communicated. Moreover, the circulation passage 55 branches off at a branch position PB in the circulation passage 55 to be communicated with both the end portions 36*a* of the reservoir 36. In addition, at a position on the upstream side of the circulation passage 55 in relation to the branch position PB in a circulation direction, a circulation pump 56 which is a circulation unit for flowing the ink into the circulation passage 55 is provided. Moreover, in the circulation passage 55 which is on the downstream side in relation to the branch position PB in the circulation direction, a filter 57 is provided as a liquid filtration unit.

Specifically, as the circulation pump 56 is operated, ink is caused to flow into the circulation passage 55 from an inflow end 55*a* which is on the upstream side of the circulation direction and is communicated with the reservoir 36. In addition, as the ink flowing into the circulation passage 55 passes through the filter 57, bubbles are removed (deaeration) or foreign matter such as solidified ink, paper powder, and dust is removed, thereby clarifying the ink. Therefore, in a state where the ink can be properly discharged when supplied to the nozzle 30, the ink flows out to the ink passage 32 from an outflow end 55*b* communicated with the communicating position PS.

Figure 4:
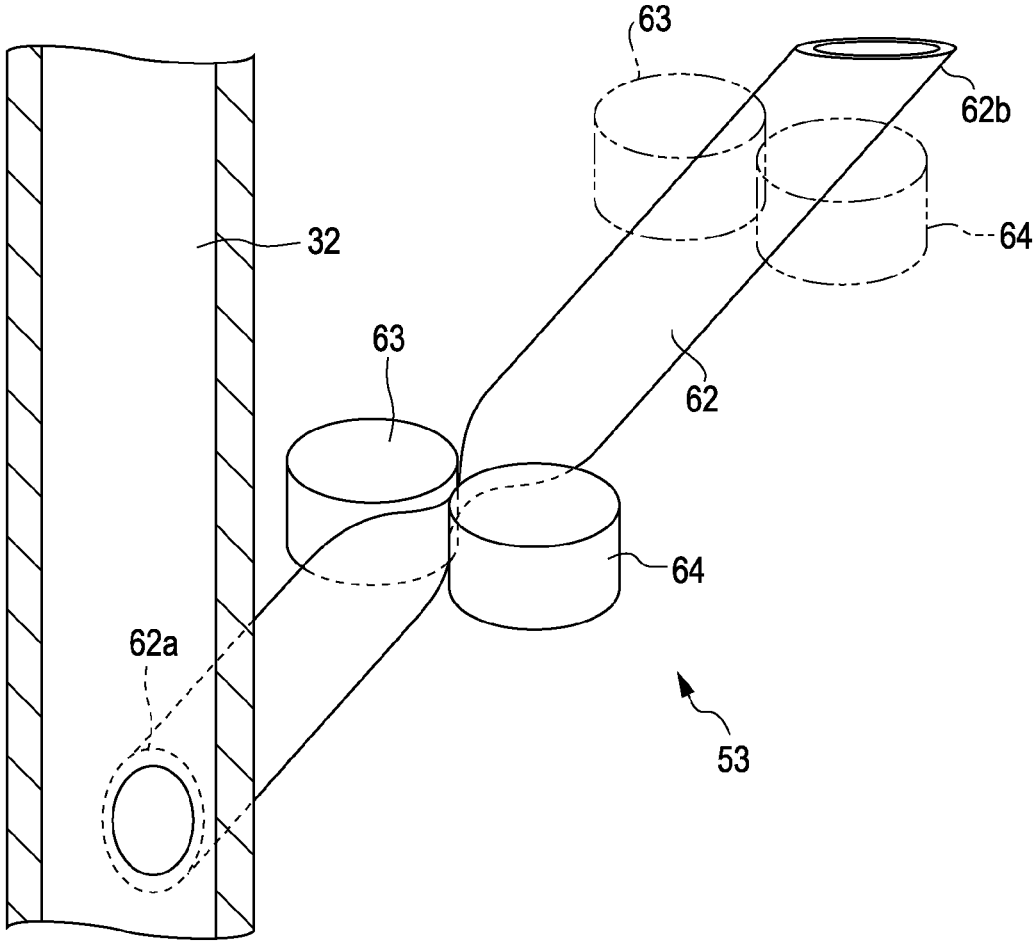
FIG. 4 is a schematic diagram of a maintenance pump.

In addition, as illustrated in FIG. 4, the maintenance pump 53 includes a tube 62 having flexibility and a pair of pressing rollers 63 and 64. Moreover, a base end portion 62*a* of the tube 62 is communicated with the ink passage 32, and a front end portion 62*b* of the tube 62 is open. The pair of pressing rollers 63 and 64 is disposed while pinching the tube 62 by squeezing both ends thereof. In addition, the maintenance pump 53 has a moving mechanism 65 (see FIG. 5) which reciprocates the pressing rollers 63 and 64 between a discharge position indicated by a solid line in FIG. 4 and a suction position indicated by a dot-dot-dashed line.

That is, as the pressing rollers 63 and 64 positioned at the discharge position which is on the base end portion 62*a* side of the tube 62 are moved to the suction position which is closer to the front end portion 62*b* side in relation to the discharge position, the ink in the ink passage 32 is sucked into the tube 62. In addition, as the pressing rollers 63 and 64 positioned at the suction position are moved to the discharge position side, the ink in the tube 62 is pushed by the pressing rollers 63 and 64 and thus is discharged to the ink passage 32. Therefore, the maintenance pump 53 performs the sucking operation and the discharging operation by causing the moving mechanism 65 to move the pressing rollers 63 and 64.

Figure 5:
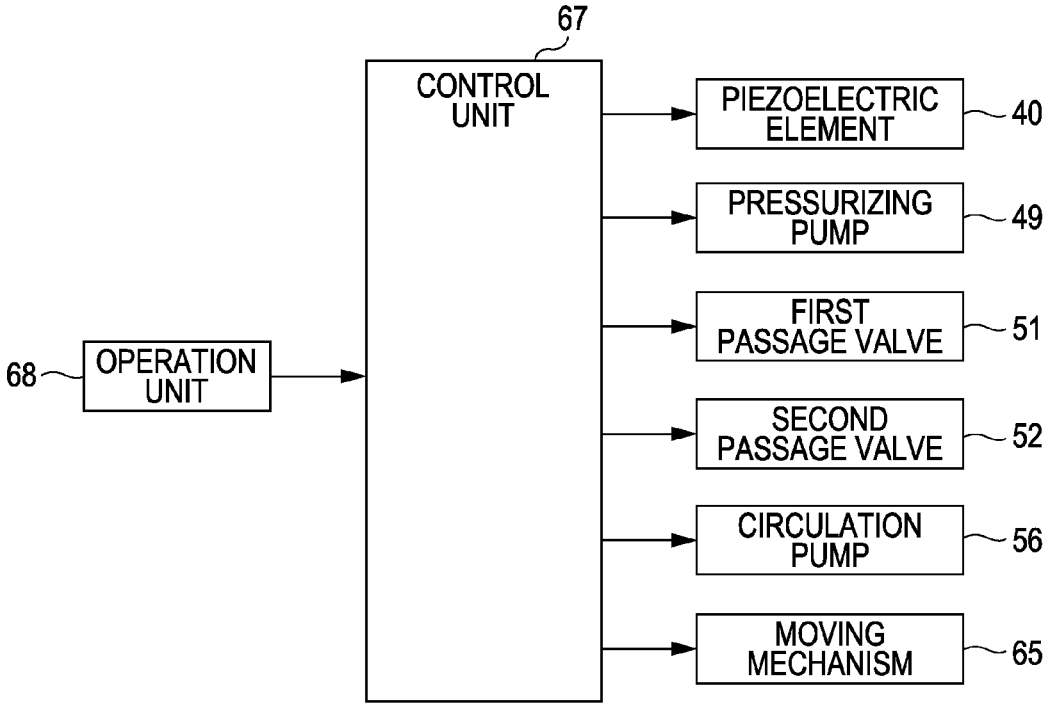
FIG. 5 is a block diagram of a control unit.

As illustrated in FIG. 5, the printer 11 is provided with a control unit 67 as a controller for controlling the overall operating statuses of the printer 11. In addition, the control unit 67 controls operations of the piezoelectric element 40, the pressurizing pump 49, the first and second passage valves 51 and 52, the circulation pump 56, and the moving mechanism 65 in response to an input from an operation unit 68 by a user, thereby performing printing and a recovery process of the nozzles 30.

Next, operations of the printer 11 configured as described above will be described.

However, when printing is started by the printer 11, the control unit 67 creates an ink ejection timing for each of the nozzles 30 on the basis of print data and operates the piezoelectric element 40 on the basis of the ejecting timing. Then, the vibration plate 39 is displaced in a direction reducing the volume of the cavity 37 to eject the ink from the nozzle 30. That is, the ink ejected from each of the nozzles 30 is adhered to the sheet 12 which is transported while being supported by the transportation belt 22, thereby performing printing on the sheet 12.

Moreover, the first and second passage valves 51 and 52 maintain opened states during printing. Therefore, when the ink is ejected from the nozzles 30 and thereby consumed, a pressure reduction caused by the reduction in amount of the ink is exerted on the upstream side via the reservoir 36 and the ink passage 32, so that the ink is supplied from the ink cartridge side.

In addition, the circulation pump 56 is being operated during the printing. Accordingly, the ink in the ink passage 32 and the reservoir 36 is circulated via the circulation passage 55 such that bubbles and foreign matter are removed.

However, in a case where air is incorporated from the nozzle opening 44 and bubbles occur in the ink, even though the piezoelectric element 40 is operated, the discharge pressure that occurs due to a change in the volume of the cavity 37 is absorbed by the bubbles. Therefore, the ink is not properly ejected from the nozzle 30, resulting in degradation of printing quality.

Accordingly, for example, in a case where the control unit 67 receives an execution command of the recovery process by the user from the operation unit 68 or determines that a predetermined time passes from the recovery process of the previous time, the control unit 67 performs the recovery process of the nozzles 30. In addition, during printing or standby which is a non-recovery process, the pressing rollers 63 and 64 of the maintenance pump 53 are positioned at the discharge position, and the first and second passage valves 51 and 52 are opened and thus the circulation pump 56 is operated.

Here, first, the control unit 67 closes the first and second passage valves 51 and 52 and operates the moving mechanism 65 to move the pressing rollers 63 and 64 at the suction position side. Accordingly, the maintenance pump 53 performs the sucking operation, so that negative pressure is accumulated between the upstream and downstream side opening and closing positions PK1 and PK2 in the ink passage 32. In addition, when the pressing rollers 63 and 64 are moved to the suction position, the control unit 67 opens the second passage valve 52 while maintaining the closed state of the first passage valve 51. Then, as compared with a case where the negative pressure is not accumulated in the ink, the ink is strongly sucked from the downstream side in relation to the first passage valve 51.

In addition, since the circulation pump 56 is operated at this time, the ink is sucked from the ink passage 32 communicated with the center portion 36*b* of the reservoir 36 and the circulation passage 55 communicated with both the end portions 36*a* (suction step).

Figure 6:
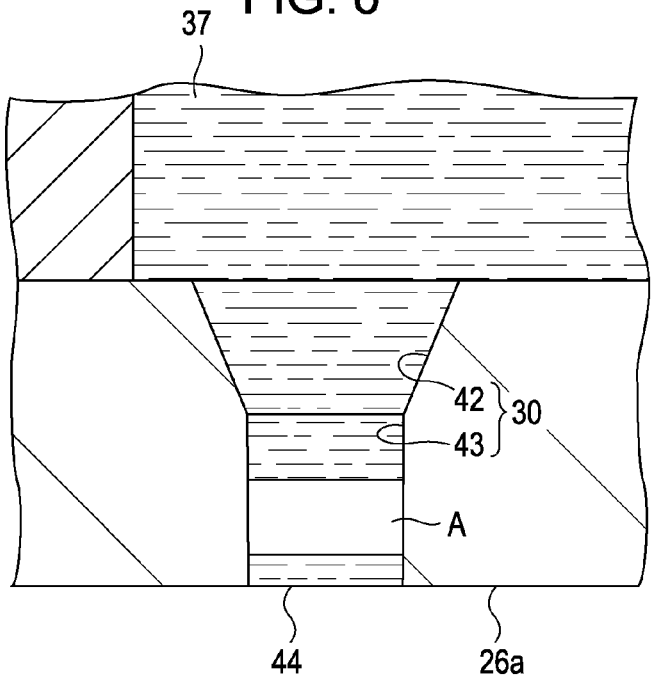
FIG. 6 is an enlarged schematic diagram of a nozzle.

However, the bigger bubbles incorporated into the ink are, the more difficult they are to move. In addition, as illustrated in FIG. 6, in a case where an air layer A is formed in the ink in the nozzle 30, the air layer A absorbs the sucking force, so that it is even more difficult to move bubbles. However, since the negative pressure is accumulated and the ink is strongly sucked by the plurality of passages (the ink passage 32 and the circulation passage 55), even in the case where large bubbles are included in the ink, the bubbles are moved to the reservoir 36 along with the ink in the nozzle 30. In addition, since both the end portions 36*a* of the reservoir 36 have larger heights than the center portion 36*b* thereof, the incorporated bubbles are moved along the upper wall and gathered at both the end portions 36*a*.

Here, the circulation pump 56 is maintained in the operated state. Accordingly, the bubbles are caused to flow into the circulation passage 55 from both the end portions 36*a* of the reservoir 36 along with the ink, pass through the filter 57, and are caused to flow out to the ink passage 32 (liquid filtration step).

Subsequently, the control unit 67 controls the moving mechanism 65 so as to cause the maintenance pump 53 to perform the discharging operation and stops the operation of the circulation pump 56. Then, the maintenance pump 53 pushes (extrudes) the ink sucked from the ink passage 32 into the tube 62 by the preceding sucking operation from the tube 62 so as to discharge the ink to the ink passage 32 (discharge step). Here, since the first passage valve 51 which is on the upstream side in relation to the pressure-changing position PH in the ink passage 32 to which the maintenance pump 53 is communicated is closed, the discharged ink is supplied to the downstream side. Therefore, the ink moving toward the upstream side due to the sucking operation of the maintenance pump 53 is moved toward the downstream side by the discharging operation of the maintenance pump 53.

Since the circulation pump 56 stops at this time, the ink in the ink passage 32 and the reservoir 36 is supplied to the nozzle 30 side by the discharge pressure of the maintenance pump 53. In addition, during the discharging operation of the maintenance pump 53, the discharge pressure is not accumulated, thereby causing the flow rate of the ink to be moderate as compared with the sucking operation.

However, when the ink in the tube 62 is maintained in the sucked state, a pressure distribution occurs in the ink passage 32 and the reservoir 36, and there is a concern that a position of the meniscus M is lowered from some nozzles 30. Accordingly, when the control unit 67 opens the second passage valve 52, the control unit 67 immediately moves the pressing rollers 63 and 64 to the discharge position. That is, "immediately" means before a movement of the partial meniscus M occurs after the maintenance pump 53 sucks the ink, and the maintenance pump 53 consecutively performs the sucking operation and the discharging operation. Moreover, whether or not the meniscus M is lowered can be detected by, for example, allowing an absorption member to come in contact with the nozzle formation surfaces 26*a* to 29*a* and determining whether or not the ink is adhered to the absorption member.

However, since the upper wall of the reservoir 36 is obliquely formed, the bubbles are gathered on upper sides of both the end portions 36*a*. In addition, as the ink in the ink passage 32 passes through the filter 57, bubbles therein are removed. Therefore, even though the maintenance pump 53 immediately performs the discharging operation, ink subjected to defoaming or ink from which bubbles are separated is supplied to the nozzle 30.

In addition, as the pressing rollers 63 and 64 are moved to the discharge position, the control unit 67 opens the first passage valve 51. Then, ink is supplied from the ink cartridge 31 in an amount equivalent to the reduced volume of the ink due to the removed bubbles. Therefore, the meniscus M of the ink is positioned in the vicinity of the nozzle opening 44 as illustrated in FIG. 3. Thereafter, the control unit 67 operates the circulation pump 56 to acquire the ink from both the end portions 36*a* of the reservoir 36 so as to pass through the filter 57, thereby performing the filtration process of ink (liquid filtration step).

According to the embodiment, the following effects can be obtained.

(1) When the maintenance pump 53 performs the sucking operation, the ink in the ink passage 32 is sucked. Then, bubbles incorporated into the ink in the nozzles 30 of the recording heads 26 to 29 are caused to flow into the branched passage 35 and the reservoir 36 along with the ink and deaerated by the filter 57. Accordingly, when the maintenance pump 53 performs the discharging operation thereafter to discharge the ink toward the ink passage 32, the ink deaerated by receiving the discharge pressure is moved to the nozzle 30 side. Moreover, as capillary force of the nozzles 30 is exerted, the nozzles 30 are filled with deaerated ink, thereby completing the recovery process of the nozzles 30. As such, during the recovery process of the nozzles 30, the bubbles incorporated into the ink can be removed without discharging the ink out of the nozzle opening 44. Therefore, the recovery process of the nozzles 30 can be performed while suppressing ink consumption.

(2) Ink in the ink passage 32 can be caused to flow by the circulation passage 55 and the circulation pump 56. Accordingly, for example, even in a case where ink evaporates and a viscosity thereof is increased, the sucked ink and ink with a small viscosity supplied from the upstream side are mixed with each other and thus the viscosity of the ink is reduced. Therefore, the viscosity of the thickened liquid can be reduced and re-filled in the nozzle 30, thereby performing the recovery process of the nozzles 30 while suppressing ink consumption.

(3) Since the filter 57 is provided in the circulation passage 55, the ink which is acquired from the ink passage 32 and flows through the circulation passage 55 passes through the filter 57 and flows out to the ink passage 32. Therefore, bubbles in the ink and foreign matter incorporated into the ink are easily removed.

(4) When the maintenance pump 53 performs the sucking operation while the first and second passage valves 51 and 52 are closed, negative pressure is accumulated between the passage valves 51 and 52 in the ink passage 32. Accordingly, when the second passage valve 52 is opened while the negative pressure is accumulated, the ink is sucked and moved to the upstream side strongly. Therefore, for example, even in the case where large bubbles which do not easily move are incorporated into the ink, the bubbles can be moved into the reservoir 36 along with the ink and can be deaerated by the filter 57.

(5) When the second passage valve 52 is opened and the ink is sucked from the downstream side, as the circulation pump 56 sucks the ink from the ink passage 32, the ink can be more strongly sucked.

(6) In the case where the ink is sucked from the single ink passage 32, it is difficult for the sucking force to reach the nozzles 30 as the nozzles 30 are distant from a connection opening of the ink passage 32. From this point of view, the ink is sucked even from the circulation passage 55 communicated with both the end portions 36*a* of the reservoir 36, thereby reducing a variation in sucking force transmitted to the nozzles 30.

(7) In the case where ink is strongly discharged, a large discharge pressure is applied to the nozzle 30 connected to the center portion 36*b* to which the ink passage 32 is communicated, and there is a concern that ink overflows from the nozzle 30. From this point of view, a flow rate of the ink discharged toward the downstream side of the ink passage 32 is caused to be moderate as compared with the case where the ink is sucked toward the upstream side of the ink passage 32, so that the variation in discharge pressure applied to the nozzles 30 can be reduced, thereby reducing concerns about the ink overflowing.

(8) In a printer for ejecting ink which contains insoluble materials (for example, particles of pigment, metal, or the like) and is more likely to generate sediment, there is a concern that the sediment occurs in the nozzle and printing quality is degraded. From this point of view, when the maintenance pump 53 performs the sucking operation and sucks the ink from the ink passage 32, even ink in the vicinity of the nozzle opening 44 is sucked into the reservoir 36. Accordingly, the ink can be agitated by being caused to flow via the circulation passage 55 in the reservoir 36. Therefore, even in the case where the pigment sediment or the like occurs in the vicinity of the nozzle opening 44, the nozzle can be recovered while suppressing ink consumption.

(9) When the maintenance pump 53 maintains the sucked state of the ink, a pressure distribution occurs in the ink passage 32, and there may be a case where the meniscus M is likely to be lowered in the nozzles 30 to the extent that the nozzles 30 are distant from the maintenance pump 53. From this point of view, after the maintenance pump 53 performs the sucking operation, the maintenance pump performs the discharging operation immediately, thereby suppressing a movement of the partial meniscus M.

Moreover, the embodiment may be modified as follows.

In the above embodiment, a pressure-reduction chamber may be provided as a defoaming unit to be adjacent to the reservoir 36 with a penetration wall through which gas penetrates interposed therebetween. That is, bubbles in the reservoir 36 may be moved to the pressure-reduction chamber via the penetration wall so as to deaerate the ink. In addition, the pressure-reduction chamber is preferably provided at both the end portions 36*a* in the reservoir 36 where bubbles are gathered. Moreover, in the case where the pressure-reduction chamber is provided, the configuration need not be provided with the circulation passage 55 and the circulation pump 56. In addition, the pressure-reduction chamber may be provided adjacent to the circulation passage 55. In this case, the pressure-reduction chamber is a liquid filtration unit.

In the above embodiments, the filter 57 may be provided inside the ink passage 32. Otherwise, the filter 57 may also be provided in the branched passage 35 or in the reservoir 36. In addition, the bubbles moving along with the ink during the operation of the maintenance pump 53 may be removed by the filter 57.

In the above embodiment, the operation of the circulation pump 56 may be stopped during the suction of the ink. That is, ink may be sucked only from the ink passage 32. Otherwise, the ink may be sucked from the branched passages which are branched from the ink passage 32 and communicated with the reservoir 36.

In the above embodiment, the circulation pump 55 may not be branched, and both ends thereof may be connected to two connection openings. In addition, the position at which the circulation passage 55 is communicated may be freely set to the ink passage 32, the branched passages 35, and the reservoir 36 on the downstream side in relation to the downstream side opening and closing position PK2. That is, for example, both the ends of the circulation passage 55 may be communicated with the reservoir 36, and the ink flowing from the reservoir 36 may be caused to flow out to the reservoir 36 via the circulation passage 55.

The position and configuration of the maintenance pump 53 are not limited to those in the above embodiment as long as the maintenance pump 53 can suck the ink in the nozzle 30 to the reservoir 36 and re-discharge the ink to the nozzle 30. For example, instead of the pressurizing pump 49 of the ink cartridge 31, a pump which is able to pressurize or depressurize the ink cartridge 31 may be employed.

In the above embodiment, a configuration without the second passage valve 52 may be employed so that sucking force is directly transferred to the nozzle 30 side when the maintenance pump 53 performs the sucking operation. That is, when bubbles are small, the bubbles may be easily moved along with the ink. Therefore, for example, when the nozzle is recovered during the time when the bubbles are small by frequently performing the nozzle recovery process, the bubbles can be moved along with the ink although negative pressure is not accumulated. In addition, in a case where a pump having a large sucking force is used, similarly, bubbles can be moved along with the ink although negative pressure is not accumulated.

In the above embodiment, the circulation pump 56 may be operated regardless of the operation state of the maintenance pump 53.

In the above embodiment, the recovery process of the nozzles may be performed by repeatedly performing the sucking operation and the discharging operation of the maintenance pump 53 a plurality of times. That is, even in the case where the nozzle 30 which cannot be recovered by the suction step and the discharge step performed one time exists, the state of the nozzle 30 can be recovered by repeating the operations a plurality of times.

In the above embodiment, as the maintenance pump 53, a piston pump or a diaphragm pump for displacing a diaphragm to change a volume of a pump chamber may be employed. In addition, in a case where the sucking operation is performed by a gear pump or a vane pump having an ink containing chamber, ink may be moved from the ink passage 32 to the ink containing chamber, and in a case where the discharging operation is performed, ink may be moved from the ink containing chamber to the ink passage 32. In addition, in the case where a gear pump or a vane pump which is able to flow the ink inside the ink passage 32 in one direction, or the pressurizing pump 49 which is able to change the flowing direction of the ink at the end portions of the ink passage 32 is used as the pump, a configuration without the first and second passage valves 51 and 52 may be employed. That is, even in the configuration without the first and second passage valves 51 and 52, an amount of ink sucked from the downstream side to the upstream side of the ink passage 32 by the sucking operation of the pump may be supplied to the nozzle 30 side by the discharging operation of the pump.

In the above embodiment, an amount of the ink discharged during the discharging operation of the maintenance pump 53 may be reduced to be smaller than an amount of the ink sucked during the sucking operation. That is, a meniscus that starts moving is moved by the capillary action, and an insufficient amount of ink is supplied via the one-way valve. Therefore, the amount of ink necessarily supplied by the maintenance pump 53 can be reduced, thereby suppressing leakage of the ink from the nozzle 30. In addition, in the configuration for causing the suction amount and the discharge amount to be different from each other, one end of the maintenance pump 53 may be communicated with the upstream side of the ink passage 32 in relation to the one-way valve so that a residual ink is discharged toward the upstream side in relation to the one-way valve.

In the above embodiment, the liquid ejecting apparatus is embodied as the ink jet printer 11. However, any liquid ejecting apparatus for ejecting and discharging liquids different from ink may be employed. This embodiment is useful for various types of liquid ejecting apparatuses having liquid ejecting heads or the like for discharging minute liquid droplets. Here, the liquid droplets represent liquid states discharged from the liquid ejecting apparatus, the liquid states including granular, tear-like, and thread-like shapes with trails. In addition, liquid mentioned herein may be any material that can be ejected by the liquid ejecting apparatus. For example, the materials may be in a liquid phase, and may include liquid-state materials with high or low viscosities, sol, gel water, fluid-state materials such as inorganic solvent, organic solvents, solutions, liquid resin, and liquid metal (metallic melt), and in addition to liquids as a state of materials, a material in which particles of functional materials made of solid such as pigment or metallic particles are dissolved, dispersed, or mixed. In addition, as representative examples of the liquid, there are the ink described above in the embodiment, liquid crystal, and the like. Here, the ink may include various kinds of liquid compositions such as general water-based ink, oil-based ink, gel ink, hot-melt ink, and the like. Particular examples of the liquid ejecting apparatus may include liquid crystal displays, EL (electroluminescence) displays, surface light-emitting displays, liquid ejecting apparatuses for ejecting liquid in which materials such as electrode materials used for manufacturing color filters and color materials are dispersed or dissolved, liquid ejecting apparatuses for ejecting biological organic materials used for manufacturing biochips, liquid ejecting apparatuses which are used as precision pipettes and used for ejecting liquid as specimens, printing apparatuses, and microdispensers. Moreover, liquid ejecting apparatuses for ejecting lubricating oil to precision machinery such as watches or cameras with pinpoints precision, liquid ejecting apparatuses for ejecting transparent resin liquid such as ultraviolet curable resin on substrates to form micro-hemispherical lenses (optical lenses) or the like used for optical communication elements or the like, and liquid ejecting apparatuses for ejecting acidic or alkaline etchant for etching substrates or the like may be employed. In addition, the embodiment of the invention may be applied to any kind of liquid ejecting apparatus.

Next, the technical idea that can be perceived from the embodiments and modified examples will be added as follows: The liquid ejecting apparatus according to any one of claims 1 to 3, further including: an upstream side passage valve that is provided at a second position which is on the upstream side in relation to a first position to which the pump is communicated with the liquid supply passage so as to be able to open and close the liquid supply passage; and a downstream side passage valve that is provided at a third position which is on the downstream side in relation to the first position in the liquid supply passage so as to be able to open and close the liquid supply passage, wherein the control unit opens the downstream side passage valve after causing the pump to perform the sucking operation while the upstream and downstream passage valves are closed.

In this configuration, as the pump performs the sucking operation while the upstream and downstream passage valves are closed, negative pressure is accumulated between the passage valves in the liquid supply passage. Accordingly, as the downstream side passage valve is opened while the negative pressure is accumulated, the liquid is sucked and strongly moved to the upstream side. Accordingly, for example, even in the case where large bubbles which do not easily move within the liquid are incorporated, the bubbles can be moved into the liquid supply passage along with the liquid, so that the liquid can be clarified by the liquid filtration unit.

The entire disclosure of Japanese Patent Application No. 2010-025279, filed Feb. 8, 2010 is expressly incorporated by reference herein.

What is claimed is:

1. A liquid ejecting apparatus comprising:

a liquid ejecting head that ejects a liquid from a plurality of nozzles;

a liquid supply passage that supplies the liquid from an upstream side which is a liquid supply source side toward a downstream side which is the nozzle side;

a pump that is able to suck the liquid from the downstream side toward the upstream side by sucking the liquid in the liquid supply passage and discharge the liquid to the liquid supply passage;

a reservoir that communicates with the downstream side of the liquid supply passage, the reservoir that is provided in the liquid ejecting head to extend along the plurality of nozzles, and the reservoir that has an inner surface of upper wall with a center and two end portions one on each side of the center, the upper wall which is being obliquely formed such that two end portions are higher than the center;

a valve located in the liquid supply passage between the pump and the reservoir;

a liquid filtration unit that clarifies the liquid in the liquid supply passage; and a circulation passage comprising:

a first end in communication with the liquid supply passage;

a branch where the circulation passage branches off to a first and second branched passage the ends of each branch passage communicating with one of the end portions of the reservoir; and a filter located with the circulation passage a circulation unit that causes the liquid in the liquid supply passage to flow from the reservoir to the first and second branched passages, into the circulation passage and causes the liquid to flow out of the first end of the circulation passage to the liquid supply passage; and a control unit that closes the valve and drives the pump to perform a sucking operation creating negative pressure in the supply passage upstream of the valve, then opens the valve to suck the liquid in the liquid supply passage to the pump, and drives the pump to perform a discharging operation to discharge the liquid sucked to the pump by the sucking operation of the pump to the liquid supply passage, thereby supplying the liquid clarified by the liquid filtration unit to the nozzle side.

2. The liquid ejecting apparatus according to claim 1, further comprising:

a circulation passage of which ends are communicated with the liquid supply passage; and a circulation unit that causes the liquid in the liquid supply passage to flow from an end of the circulation passage into the circulation passage and causes the liquid to flow out of another end of the circulation passage to the liquid supply passage.

3. The liquid ejecting apparatus according to claim 2, wherein the liquid filtration unit is a filter provided in the circulation passage.

4. A nozzle recovery method used in a liquid ejecting apparatus which includes a plurality of nozzles that eject a liquid, and a liquid supply passage that supplies the liquid from an upstream side which is a liquid supply source side to a downstream side which is the nozzle side, the nozzle recovery method comprising:

sucking the liquid in the liquid supply passage by driving a pump, which is able to suck the liquid in the liquid supply passage and discharge the liquid in the liquid supply passage, to perform a sucking operation such that the liquid is sucked from the nozzle side;

clarifying the liquid sucked in the sucking; and discharging the clarified liquid toward the nozzle side by driving the pump to perform a discharging operation.

5. A liquid ejecting apparatus according to claim 1, wherein the pump that is able to suck the liquid out of the liquid supply passage and discharge the liquid back into the supply passage.

6. A liquid ejecting apparatus according to claim 5, wherein the pump removes the liquid from the supply passage to a tube within a pump that is external the liquid supply passage and replaces the liquid back to the supply passage.

* * * * *